US005223850A

United States Patent [19]

Branigan et al.

[11] Patent Number: 5,223,850

[45] Date of Patent: Jun. 29, 1993

[54] LOW-PROFILE FULL APERTURE MONOPULSE ANTENNA ASSEMBLY

[75] Inventors: John T. Branigan, Claremont; Ronald S. Miller, LaVerne, both of Calif.

[73] Assignee: Hughes Aircraft Company, Los Angeles, Calif.

[21] Appl. No.: 261,665

[22] Filed: Oct. 24, 1988

[51] Int. Cl.[5] ..... H01Q 13/10

[52] U.S. Cl. ..... 343/771

[58] Field of Search ..... 343/770, 771, 767

[56] References Cited

U.S. PATENT DOCUMENTS 4,121,220 10/1978 Scillieri et al. ..... 343/771

4,700,193 10/1987 Sa et al. ..... 343/770

*Primary Examiner*—Theodore M. Blum

*Attorney, Agent, or Firm*—C. D. Brown; R. M. Heald; W. K. Denson-Low

[57] ABSTRACT

A low-profile full aperture traveling wave monopulse antenna assembly including a circular faceplate having a plurality of parallel rows of radiating apertures formed therethrough, a circular backplate having a pair of feed openings each extending across the backplate on opposite sides of and parallel to a centrally located chord perpendicular in orientation to the rows of radiating apertures, a circular backplate mounted between and spaced apart from the faceplate and the backplate by a plurality of walls forming a plurality of parallel waveguide channels therein, a pair of feed waveguides each mounted adjacent the backplate above a different feed opening and each electromagnetically coupled to opposite ends of the waveguide channels, and a monopulse comparator network mounted adjacent the backplate and coupled to the pair of feed waveguides.

14 Claims, 8 Drawing Sheets

LOW-PROFILE FULL APERTURE MONOPULSE ANTENNA ASSEMBLY

BACKGROUND OF THE INVENTION

Technical Field

The present invention relates to monopulse tracking antennas. More specifically, the present invention relates to a novel and improved flat plate slotted array monopulse seeker antenna assembly in a low-profile, compact configuration.

Background Art

Weapons utilizing microwave radar systems suffer serious performance degradation in a jamming environment. Since the potential for jamming is high in almost all tactical situations, techniques to improve electronic countermeasures capability for these systems are a vital necessity. In particular, presently deployed microwave tracking systems are susceptible to standoff jammers due to the relatively high sidelobes of their antennas. Since the geometry required to position a jammer in the antenna main lobe has a low probability of occurrence, the highest probability is that the jammer will intercept the antenna pattern in its sidelobes. Hence, antenna design techniques which improve sidelobe levels without comprising other performance characteristics can provide significant improvement in vulnerability to jamming signals.

Two types of monopulse antennas, parabolic reflectors and slotted arrays, are commonly used in many present-day active and semi-active radar systems. The parabolic reflector and slotted array antennas respectively utilize amplitude comparison and phase comparison monopulse techniques. However, each of these two types of monopulse antennas has inherent design limitations which result in sidelobe levels higher than desired for operation in a jamming environment.

Parabolic reflector seeker antennas, usually are comprised of a parabolic dish and a four port waveguide monopulse feed system, are subject to considerable aperture blockage. Due to the inherent blockage effects, a typical parabolic reflector seeker antenna will produce sidelobes in the elevation plane of the sum port on the order of −16 to −18 dB.

Slotted array antennas are often utilized as seeker antennas in missile systems since they can be designed physically compact and are readily adaptable to gimbal mounts. However, slotted array antennas produce high sidelobes in both the azimuth and elevation difference channels, typically −11 to −15 dB. The high sidelobes in the difference channels are a result of the aperture distribution being designed to optimize the sum channel performance in terms of gain and beamwidth. In the slotted array antennas, the difference patterns are obtained by comparing phase value between corresponding halves of the array. However, the difference mode amplitude distribution in the slotted array antenna suffers a severe discontinuity at the array center. As a result of this discontinuity, high sidelobes are produced which degrade the performance of the antenna in the jamming environment. It has been demonstrated that sidelobe levels of at least −25 dB must be achieved in order to survive the standoff jamming environment typical of most combat scenarios. Hence, it is obvious that each of the parabolic reflector and slotted array antenna types suffer substantial degradation in radar system performance in jamming environments.

The slotted array antenna is the preferred antenna type due to its physical size compactness it is the most vulnerable antenna type in the jamming environment. The typical slotted array antenna implemented in a phase comparison monopulse system, experiences the most significant degradation in system performance when jammer noise is received through one of the difference channels. It is, therefore, advantageous to use the slotted array antenna in an amplitude comparison mode to meet the low sidelobe requirements and size limitations in missile applications.

Slotted array antennas have been previously mentioned for use in monopulse tracking applications while using dual-directional traveling wave techniques to achieve the amplitude comparison mode. These techniques are utilized to reduce sum and difference sidelobes. However, no such slotted array antenna has been designed in a compact, low-profile configuration required for missile seeker antenna applications while using amplitude comparison monopulse techniques. Slotted array antennas have advantages over other types of antennas in missile seeker applications due to space limitations and strict gimbal mount requirements. Hence, slotted array antennas utilizing dual-directional traveling wave techniques are preferred in missile seeker antenna applications due to their inherent low sidelobe levels.

It is, therefore, an object of the present invention to provide a novel and improved low sidelobe flat plate slotted array amplitude comparison monopulse seeker antenna implemented in a compact, low-profile configuration.

It is yet another object of the present invention to provide an amplitude comparison monopulse seeker antenna utilizing dual-directional traveling wave techniques and configured as a compact, low-profile, flat plate slotted array having low sidelobes in both the sum and difference channels.

SUMMARY OF THE INVENTION

The present invention is a compact, low-profile flat plate slotted array monopulse seeker antenna assembly. The antenna assembly is a full aperture traveling wave monopulse antenna which includes a circular faceplate having a plurality of parallel rows of radiating apertures formed therethrough. The antenna includes a circular backplate having a pair of feed openings each extending across the backplate on opposite sides of and parallel to a centrally located chords perpendicular in orientation to the rows of radiating apertures. A circular centerplate is mounted between and spaced apart from the faceplate and the backplate by a plurality of walls forming a plurality of parallel waveguide channels therein. A first set of parallel waveguide channels is disposed between the faceplate and the centerplate with each waveguide channel of the first set being parallel to and electromagnetically coupled to a corresponding row of radiating apertures. A second set of parallel waveguide channels is disposed between the backplate and the centerplate with each waveguide channel of the second set being symmetrically oriented on an opposite side of the centerplate with respect to a corresponding waveguide of the first set. The centerplate further includes divider means mounted within the second set of waveguide channels for separating each waveguide channel of the second set into pairs of independent waveguide channels. One waveguide channel of each of the pairs of independent waveguide channels is coupled to one feed opening while the other waveguide channel of each pair of independent waveguide channels is coupled to the other feed opening. The centerplate further includes a plurality of coupling apertures each formed therethrough adjacent to the periphery thereof within the region defined by corresponding waveguide channels of the first and second sets so as to electromagnetically couple the corresponding waveguide channels of the first and second sets.

A pair of feed waveguides are each mounted adjacent the backplate above a different feed opening. One feed waveguide is electromagnetically coupled to one waveguide channel in each one of the pairs of independent waveguide channels while the other feed waveguide is coupled to the other waveguide channels of the pairs of independent waveguide channels.

A monopulse comparator is mounted adjacent the backplate and operatively coupled to the pair of feed waveguides. The comparator includes first, second, third and fourth hybrid tees each having a pair of symmetry arms, a sum arm and a difference arm. The first hybrid tee symmetry arms are respectively coupled to a different end of one of the feed waveguides. The second hybrid tee symmetry arms are respectively coupled to a different end of the other of the feed waveguides. The third hybrid tee symmetry arms are respectively coupled to the first and second hybrid tee difference arms. The fourth hybrid tee symmetry arms are respectively coupled to the first and second hybrid tees sum arms.

The compact, low-profile configuration of the antenna assembly of the present invention is designed for missile seeker applications where the size and space envelope for the antenna and monopulse comparator are quite limited. A full aperture traveling wave monopulse seeker antenna assembly using amplitude comparison monopulse techniques provides significantly improved techniques for electronic countermeasure capability in microwave detection systems through reduced sidelobe levels and acceptable antenna gain.

To reduce the sidelobes typically encountered in slotted arrays, a dual-directional traveling wave technique is employed. As an example, a single rectangular linear waveguide having radiating slots spaced along the wide surface of the waveguide may be considered. For a given slot spacing and waveguide wavelength, traveling wave radiation in the waveguide results in a beam tilted off a particular boresight axis of the radiating waveguide at an angle $\theta$. The angle of beam tilt, $\theta$, is determined by the following equation:

$$\sin\theta = \frac{\lambda}{\lambda g} - \frac{\lambda}{2d} \quad (1)$$

where $\lambda$ is the operating frequency, $\lambda g$ is the wavelength in the waveguide, and d is the distance between radiating elements.

In particular, the direction of the traveling wave in the waveguide determines a left or a right beam position off boresight.

When the two inputs or ends of the radiating waveguide are respectively coupled to a different symmetry arm of a hybrid tee, the resultant beam position will be that characteristic of an amplitude comparison monopulse antenna. The amplitude comparison monopulse beam position has a sum port lobe along the boresight axis with a pair of delta port lobes symmetrically off the boresight axis.

This dual-directional traveling wave technique is then extended to a two-plane configuration by coupling of the slot array or radiating waveguide to a feed waveguide system. The feed waveguide system consists of a pair of feed waveguides. The feed waveguides are positioned perpendicular to the radiating waveguide with feed waveguide coupled to one end of the radiating waveguide and the other feed waveguide coupled to the other end of the radiating waveguide. Each feed waveguide has a coupling slot which couples traveling wave energy between a feed waveguide and a corresponding end of a radiating waveguide. The feed waveguides couple the energy in a first plane to the radiating waveguide of an orthogonal plane to provide the two-plane configuration. Utilizing the just described feed technique, a four port system is achieved such that each beam from the four ports is pointing at a specific angle off boresight. The four ports are then combined in a monopulse comparator arithmetic network, which consists of four interconnected waveguide or stripline or microstrip hybrid tees, to provide the required amplitude comparison monopulse performance.

In particular, the ends of one feed waveguide are respectively coupled different symmetry arms of a first hybrid tee. The ends of the other feed waveguide are respectively coupled to different symmetry arms of a second hybrid tee. Furthermore, the difference arms of the first and second hybrid tees are respectively coupled to different symmetry arms of a third hybrid tee. The sum arms of the first and second hybrid tees are respectively coupled to different symmetry arms of a fourth hybrid tee. The sum arm and the difference arm of the third hybrid tee respectively define the antenna sum port and antenna azimuth port of the amplitude comparison monopulse antenna assembly. The difference arm of the fourth hybrid tee defines the antenna elevation port of the amplitude comparison monopulse antenna assembly.

BRIEF DESCRIPTION OF THE DRAWINGS

These and other features, objects, and advantages of the present invention will be more fully apparent from the detailed description set forth below taken in conjunction with the drawings in which like reference characters identify correspondingly throughout and wherein.

DETAILED DESCRIPTION OF THE PREFERRED EMBODIMENTS

Figure 1:
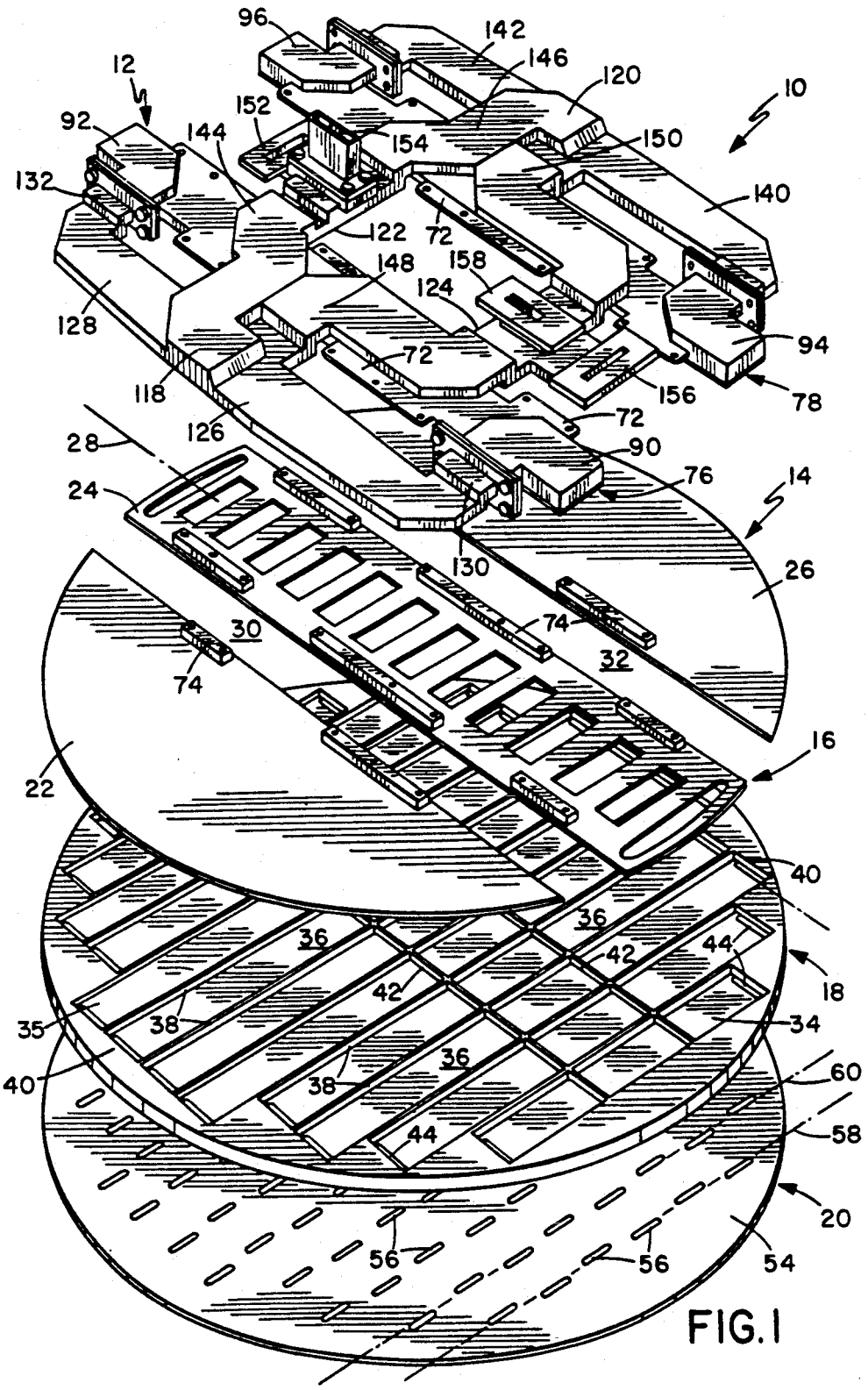
FIG. 1 is an exploded perspective view of the basic components of the antenna assembly of the present invention.
Figure 4:
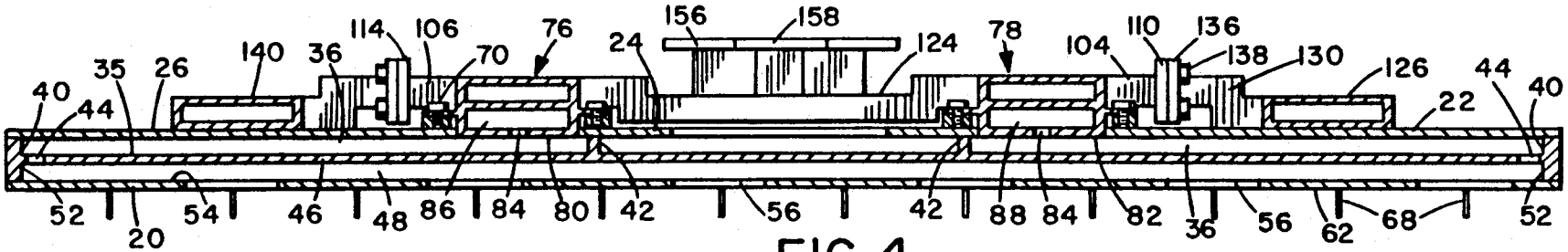
FIG. 4 is an enlarged sectional view taken on line 4—4 of FIG. 2.
Figure 5:
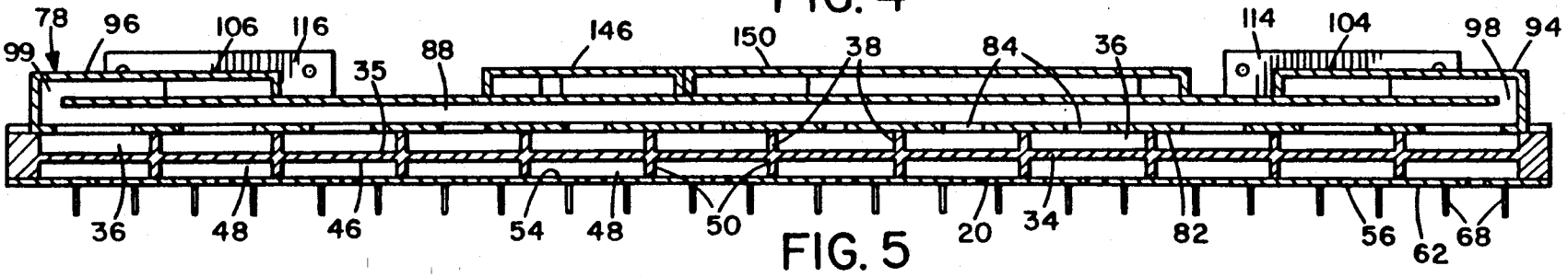
FIG. 5 is an enlarged sectional view taken on line 5—5 of FIG. 2.

Referring to FIG. 1, there is shown an exploded perspective view of the basic components of antenna assembly 10. The structural detail of the antenna assembly 10 are further shown in FIGS. 2, 4 and 5. Antenna assembly 10 is comprised of a waveguide monopulse comparator and feed waveguide assembly 12 mounted on antenna radiating section 14. Antenna radiating section 14 is comprised of backplate 16, center waveguide channel section 18 and faceplate 20. Antenna radiating section 14 is typically of a circular design with an overall diameter of approximately 10 wavelengths of the antenna center operating frequency.

Backplate 16 is comprised of three flat sections, backplate sections 22, 24 and 26. Backplate section 24 is mounted on center waveguide channel section 18 and is positioned centrally along a center axis of symmetry axis 28. Backplate sections 22 and 26 are mounted on opposite sides of axis 28 and are spaced apart from backplate section 24 when mounted on center waveguide channel section 18. The spaced apart areas between backplate sections 22 and 24, and between backplate sections 24 and 26 respectively define parallel gaps 30 and 32 which function as feed openings into center waveguide channel section 18 when backplate 16 is mounted thereupon. Through gaps 30 and 32 electromagnetic energy from monopulse comparator and feed waveguide assembly 12 is coupled into selected portions of the waveguide channels formed in center waveguide channel section 18.

Center waveguide channel section 18 is comprised of a substantially flat centerplate 34 formed having on an upper surface 35 a plurality of parallel waveguide channels 36. Waveguide channels 36 are defined by a plurality of spaced apart parallel sidewalls 38, formed on surface 35 perpendicular to axis 28, along with periphery walls 40 and central walls 42. Periphery walls 40 and central walls 42 are parallel with each other and extend along the surface 35 of centerplate 34 parallel to axis 28. Sidewalls 38, periphery walls 40 and central walls 42 all extend substantially perpendicularly upwardly away from surface 35 for engaging backplate 16. Central walls 42 are typically positioned beneath backplate section 24 symmetrically about axis 28. Periphery walls 40 are typically formed symmetrically about axis 28 adjacent the periphery of centerplate 32 and are positioned beneath backplate sections 22 and 26. The distance (a) between sidewalls 38 is defined by the following equation (2).

$$a = \frac{\lambda}{\sqrt[2]{1 - \frac{(\lambda)^2}{\lambda g}}} \quad (2)$$

The distance (s) between periphery walls 40 and a corresponding central wall 42 is defined by the following equation (3).

$$S = (N - 1)d + \frac{3\lambda g}{4} \quad (3)$$

With backplate 16 mounted upon center waveguide channel section 18, waveguide channels 36 are each of a substantially rectangular shape.

In centerplate 34, adjacent periphery walls 40, are coupling slots 44 which extend through centerplate 34 from surface 35 to lower surface 46. Formed on lower surface 46 are a plurality of parallel waveguide channels 48. Waveguide channels 48 extend across centerplate 32 perpendicular to axis 28. Each waveguide channel 48 is defined by walls that are coplanar with the walls of a corresponding waveguide channel 36. Waveguide channels 48 are defined by spaced apart sidewalls 50, formed on surface 46, that are coextensive with sidewalls 38 on surface 35. Each waveguide channel 48 includes a pair of periphery walls 52, formed on surface 46, that are parallel to axis 28 and are located about the periphery of centerplate 32. Periphery walls 52 are coextensive with periphery walls 40 located on surface 35. Waveguide channels 48 do not include a central wall as did waveguide channels 36, but do extend along parallel chords from periphery to periphery of center plate 34. Sidewalls 50 and periphery walls 52 extend perpendicularly downwardly away from surface 46 and are of a height identical to those of the walls on surface 35. Mounted upon sidewalls 50 and periphery walls 52 is surface 54 of faceplate 20.

With faceplate 20 mounted upon center waveguide channel section 18, waveguide channels 48 are each of a substantially rectangular shape. Faceplate 20 has formed therethrough a plurality of radiating slots 56 which are formed along parallel chords, such as chords 58 and 60, such that the row of radiating elements 56 extend along a corresponding waveguide channel 48. Each row of radiating slots 56 are positioned about a chord that is centrally located between sidewalls 50 and extends along the length of a corresponding waveguide channel 48. Radiating slots 56, positioned along a corresponding chord, are located a slight distance off the corresponding chord near the periphery of faceplate 20. The position of slots 56 off the corresponding chord increases in distance going towards the midpoint of the chord from the periphery of faceplate 20.

In a preferred embodiment of the invention, backplate 20, centerplate 32 and face plate 54 are typically of a thickness of 0.030 inches. The walls separating centerplate 32 from backplate 16 and faceplate 20 are typically 0.150 inches thick. Therefore, the thickness of the entire antenna radiating section 14 is 0.240 inches. Antenna radiating section 14 is, therefore, of a low-profile and compact thickness for applications where height restrictions severely limit the thickness of the antenna radiating section.

Figure 6:
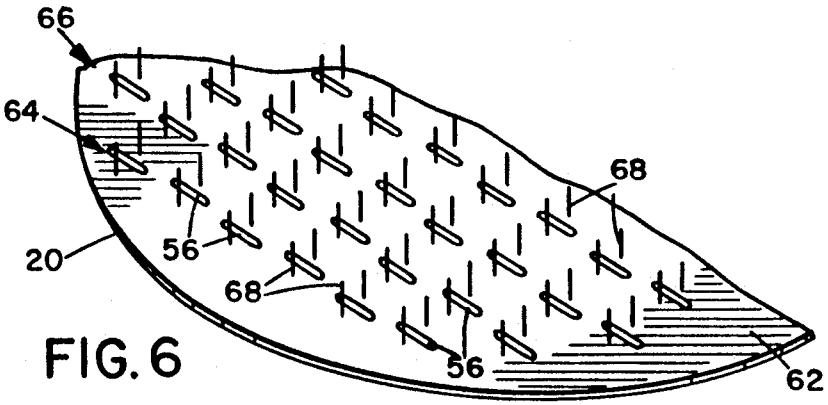
FIG. 6 is a perspective view of a portion of the front face of the antenna assembly faceplate.

As an option to the present invention, improvement in slot isolation from adjacent row slots may be provided. As illustrated in FIG. 6, faceplate 20 has surface 62 opposite surface 54 which is the front surface of the antenna assembly. Mounted upon surface 62 are means for improving the isolation of a slot in one row from slots in adjacent rows. For example, slots 56 in row 64 are isolated from mutual coupling of electromagnetic energy from an adjacent slot 56 in adjacent row 66. One typical way of providing such isolation is employing posts known as Clavin pins 68 mounted on surface 62 perpendicularly thereto. Clavin pins 68 are mounted on opposite sides of each slot 56 such that a pair of Clavin pins 68 are positioned between adjacent slots 56 in row 64 and 66. Another way to provide slot isolation is to employ baffles, i.e., fences between adjacent rows of slots.

Figure 2:
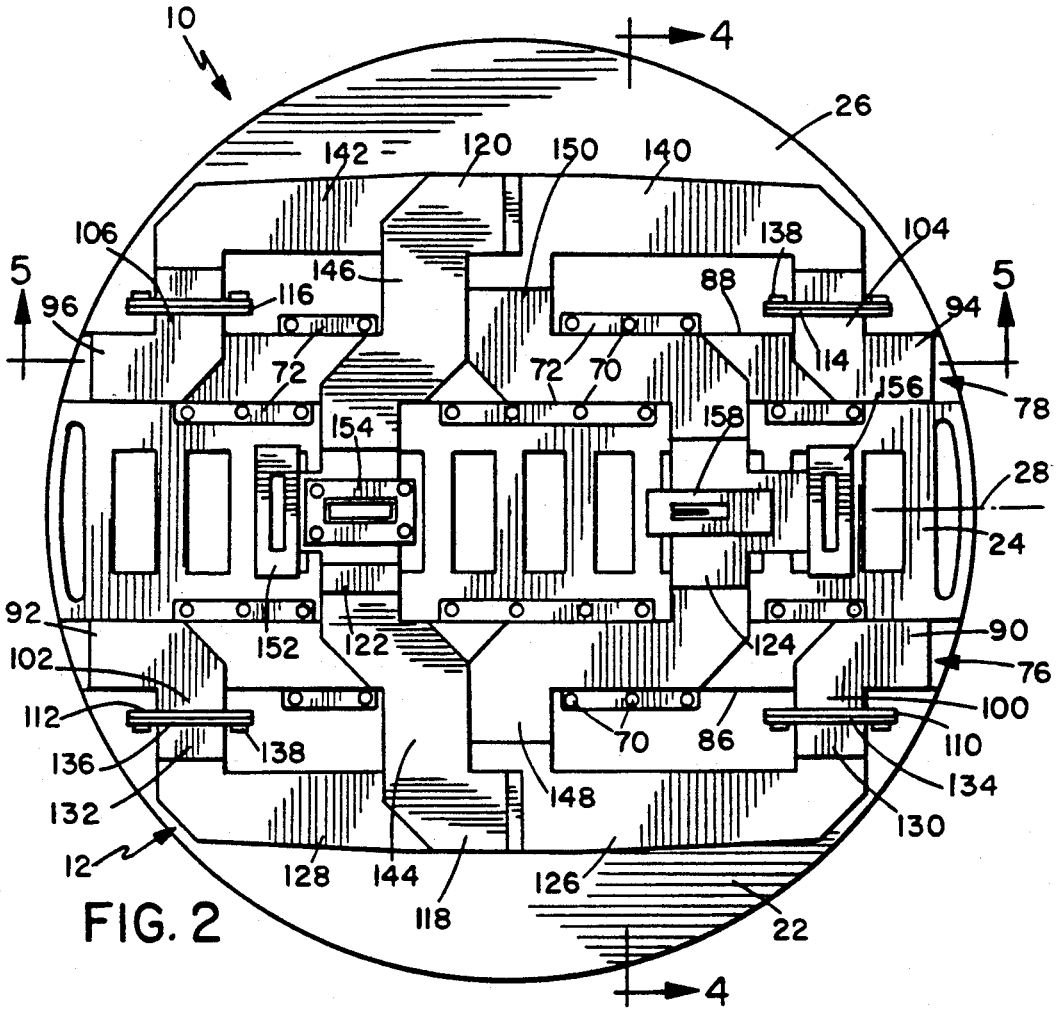
FIG. 2 is a rear face view of the assembled antenna assembly.
Figure 3:
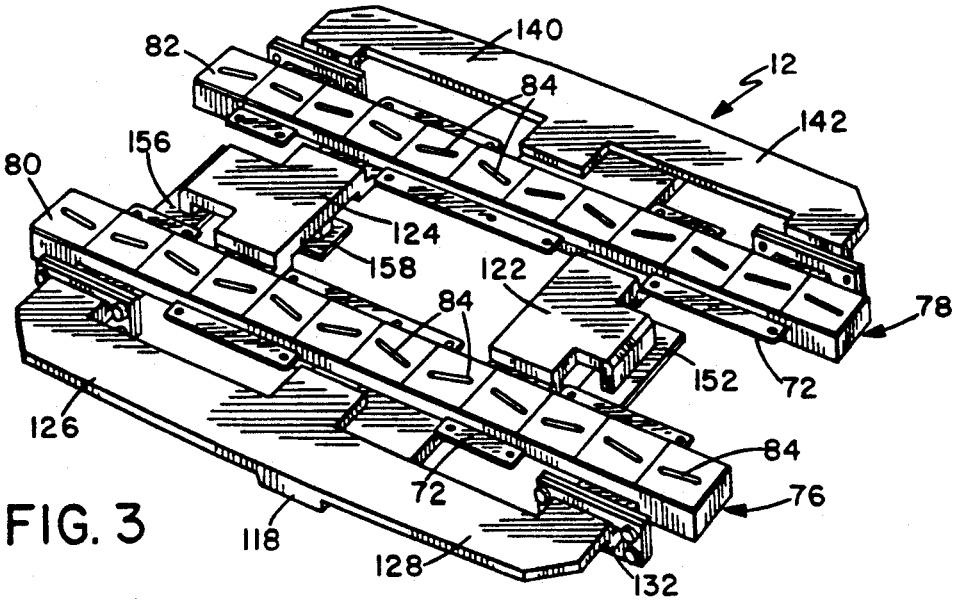
FIG. 3 is a perspective view showing the forward face of the waveguide assembly.

FIG. 2 illustrates a rear face view of antenna assembly 10 showing monopulse comparator and feed waveguide assembly 12 mounted upon antenna radiating section 14. FIGS. 1, 3, 4 and 5 taken in conjunction with FIG. 2, illustrate additional details of the mounting of monopulse comparator and feed waveguide assembly 12 upon antenna radiating section 14. Monopulse comparator and feed waveguide assembly 12 is fixed upon the antenna radiating section 14 by screws 70 which extend through brackets 72 and are threadably engaged in mounting blocks 74 mounted on backplate 16. The antenna, after assembly, must be aluminum dip brazed so that contact integrity is achieved.

When monopulse comparator and feed waveguide assembly 12 is positioned on antenna radiating section 14 a pair of feed waveguides, feed waveguides 76 and 78 (FIG. 3), respectively fit with respective faces 80 and 82 within gaps 30 and 32 such that the row of radiating slots 84 in faces 80 and 82 overlie a different waveguide channel 36. Radiating slots 84 are positioned along a center line running the length of faces 80 and 82. Adjacent radiating slots 84 along the length of a respective face are offset at opposite oblique angles with the angle increasing towards the midpoint of the length of the face.

Referring particularly to FIGS. 2, 3, 4 and 5, feed waveguides 76 and 78 are each respectively comprised of rectangular radiating portion 86 and 88 with each having faces 80 and 82 containing radiating slots 84. Radiating portions 86 and 88, as mounted upon antenna radiating section 14, define a first level above backplate 16. A pair of rectangular connector portions are coextensively positioned above the radiating portions in a second level, in regions adjacent the ends of each radiative portion. Connector portions 90 and 92 are mounted above radiating portion 86 at the ends thereof adjacent the periphery of antenna radiating section 14. Connector portions 90 and 92 extend from adjacent the periphery of antenna radiating section 14 inwardly along the radiating portion 86 towards the midpoint of the length of radiating portion 86. Connector portions 90 and 92 are mounted directly upon and coextensively extend along radiating portion 86 so as to define a second level above backplate 16. Connector portions 94 and 96 are similarly formed upon radiating portion 88.

A coupling slot is positioned in the region adjacent each end of a radiating portion between the radiating portion and the connector portion. Each slot electromagnetically couples the radiating portion to the connector portion. For example, slots 98 and 100 respectively couple connector portions 94 and 96 to radiating portion 88. Similarly, connector portions 90 and 92 are respectively connected by coupling slots (not shown) to radiating portion 86. Each feed waveguide 76 and 78 also has a rectangular coupling portion attached to the end of a respective connector portion at the end opposite where the coupling slot connects the connector portion and radiating portion. For example, coupling portions 100, 102, 104 and 106 are respectively connected to connector portions 90, 92, 94 and 96. Coupling portions 100, 102, 104 and 106 are in the second level above a corresponding radiating portion and extend at an angle perpendicular to a respective connector portion in a direction away from axis 28. At an end opposite the connection between a coupling portion and a corresponding connector portion is a waveguide flange. Respectively mounted at the ends of coupling portions 100, 102, 104 and 106 are waveguide flanges 110, 112, 114 and 116. The waveguide flanges 110, 112, 114 and 116 are adapted for connecting the respective coupling portion to the symmetry arms of a hybrid tee in a monopulse comparator assembly as described below.

The monopulse comparator assembly illustrated in FIGS. 1, 2, 3, 4 and 5 is comprised of hybrid tees 118, 120, 122 and 124 each having a pair of symmetry arms, a sum arm and a difference arm. Hybrid tees 118 and 120 are both typically respectively positioned between feed waveguides 76 and 78 and the periphery of antenna radiating section 14, approximately at the midpoint along axis 28. Hybrid tees 122 and 124 are both typically respectively positioned between feed waveguides 76 and 78 along axis 28 and symmetrical about the midpoint of axis 28.

The symmetry arms of hybrid tee 118, arms 126 and 128, are mounted in the first level adjacent the backplate and are each of a tapered, rectangular waveguide which extends out from hybrid tee 118 substantially parallel to axis 28. Arms 126 and 128 each include a perpendicular coupling section, respectively coupling sections 130 and 132, which extend from an end opposite hybrid tee 118. Coupling sections 130 and 132 extend inwardly perpendicular towards axis 28 in the first level, upwardly to the second level and then finally inwardly perpendicular to axis 28, while terminating respectively at mating flanges 134 and 136. Waveguide flanges 110 and 112 mate with mating flanges 134 and 136 which are secured together by screws 138. Similarly, hybrid tee 120 has symmetry arms 140 and 142 coupled to waveguide flanges 114 and 116 as was described with reference to symmetry arms 126 and 128.

The difference port of hybrid tee 118 is coupled to a rectangularly-shaped waveguide which is symmetry arm 144 of hybrid tee 122. Similarly, the difference port of hybrid tee 120 is coupled to a rectangularly-shaped waveguide which is symmetry arm 146 of hybrid tee 122. Both symmetry arms 144 and 146 respectively extend from hybrid tees 118 and 120 in the second level. Symmetry arms 144 and 146 extend inwardly towards axis 28 respectively crossing over radiating portions 86 and 88 of feed waveguide 76 and 78. Symmetry arms 144 and 146 then extend perpendicularly downwardly towards faceplate 16 into the first level. In the first level, symmetry arms 144 and 146 extend inwardly towards axis 28 where they connect to hybrid tee 122.

The sum ports of hybrid tees 118 and 120 are respectively coupled to rectangularly-shaped waveguides that are symmetry arms 148 and 150 of hybrid tee 124. Symmetry arms 148 and 150 extend from the respective hybrid tees 118 and 120 in the first level adjacent backplate 16. Symmetry arms 148 and 150 extend inwardly towards axis 28 and extend perpendicularly upward into the second level. Symmetry arms 148 and 150 then extend in the second level inwardly towards axis 28 parallel to backplate 16 over radiating portions 86 and 88 of feed waveguide 76 and 78. Symmetry arms 148 and 150 then extend parallel to axis 28, in the second level above radiating portions 86 and 86, in a direction opposite hybrid tee 122 towards hybrid tee 124. Symmetry arms 148 and 150 then extend inwardly in the second level towards axis 28 and perpendicularly downwardly to the first level where they extend inwardly towards axis 28 for coupling to hybrid tee 124.

Hybrid tee 122 includes a sum port that is a rectangularly-shaped waveguide which extends along axis 28 in the first level, parallel to backplate 16, outwardly towards the periphery of antenna radiating section 14. The sum port then extends perpendicularly away from backplate 16 where it is terminated at waveguide flange 152. The sum port terminating at waveguide flange 152 is typically used in the antenna assembly as the antenna azimuth port. The difference port of hybrid tee 122 is a rectangularly-shaped waveguide which extends perpendicular to backplate 16 from the first level to the second level where it is terminated by a load, such as a wedge-shaped piece of carbon (not shown), mounted in termination fixture 154.

Hybrid tee 124 is configured similarly to hybrid tee 122 with the sum port being a rectangularly-shaped waveguide which extends along axis 28 in the first level, parallel to backplate 16, outwardly towards the periphery of antenna radiating section 14. The sum port then extends perpendicularly upwardly away from backplate 16 where it is terminated at waveguide flange 156. The sum port terminating at waveguide flange 156 is typically used in the antenna assembly as the antenna sum port. The difference port of hybrid tee 124 is a rectangularly-shaped waveguide which extends perpendicular to backplate 16 from the first level to the second level where it is terminated by waveguide flange 158. The difference port terminating at waveguide flange 158 is typically used in the antenna assembly as the antenna elevation port.

Figure 7:
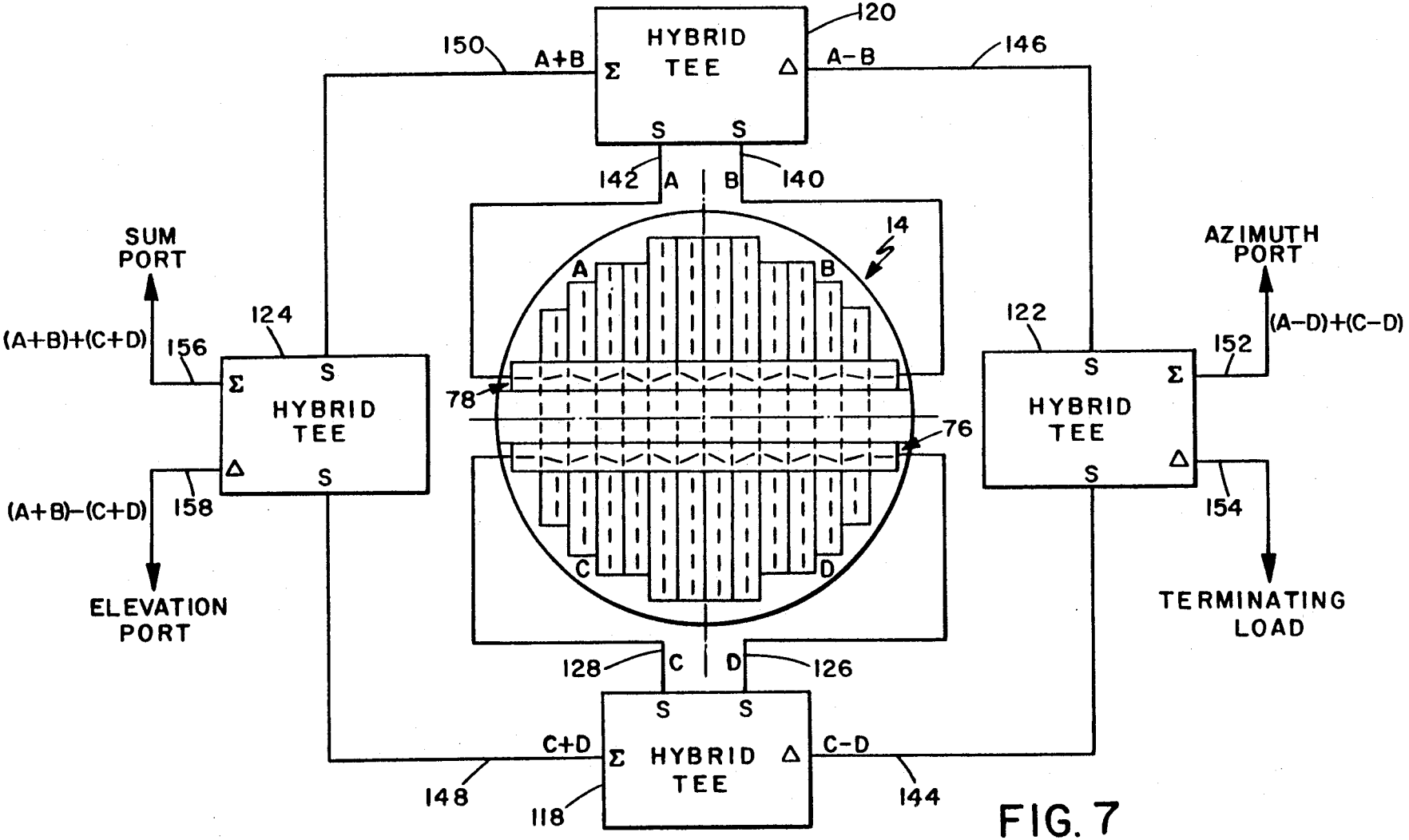
FIG. 7 is a schematic arrangement of the antenna assembly system.

FIG. 7 illustrates a schematical representation of the connection of hybrid tees of the monopulse comparator assembly to the feed waveguide 76 and 78 and antenna radiating section 14. Reference numerals referred to in FIG. 7 correspond to those used previously with reference to in FIGS. 1-6. FIG. 7 illustrates the schematic connections necessary to implement a full aperture traveling wave monopulse antenna system as described herein.

The antenna assembly is preferably constructed with the radiating section being 10 inches in diameter and all materials being preferably of a lightweight material such as aluminum. The construction employed utilizes lightweight materials for weight savings. Utilizing the construction design of the two level monopulse comparator and feed waveguide assembly and antenna radiating section as described herein permits a low-profile configuration to be realized.

Figure 8:
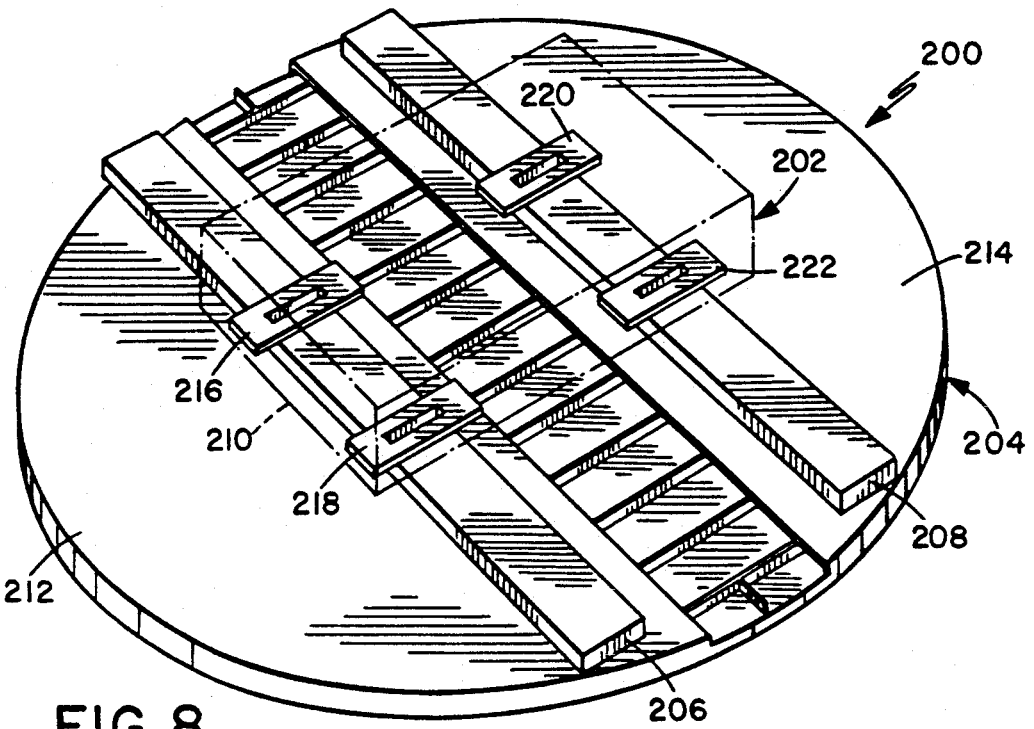
FIG. 8 is a rear elevation view of an alternative antenna assembly having a feed network adapted for coupling to a stripline monopulse comparator.

FIG. 8 illustrates a rear elevation view of an alternate embodiment on the antenna assembly having a feed network adapted for coupling a stripline comparator thereto. In FIG. 8, antenna assembly 200 is comprised of a stripline monopulse comparator and feed waveguide assembly 202 and antenna radiating section 204. Stripline monopulse comparator and feed waveguide assembly is comprised of a pair of feed waveguides 206 and 208 that couple stripline monopulse comparator 210 (illustrated in dashed lines for purposes of clarity) to antenna radiating section 204. Antenna radiating section 204 is identical to that of antenna radiating section 14 of the first embodiment of the invention with minor modification in the backplate to permit integral coupling of feed waveguides 206 and 208 thereto.

Feed waveguides 206 and 208 are essentially identical to feed waveguides 76 and 78 of the first embodiment with each having radiating and connector portions. However, the coupling portions of feed waveguides 206 and 208 each extend perpendicularly upwardly with respect to antenna radiating section backplate sections 212 and 214, rather than extending at an angular perpendicularly outwardly towards the periphery of antenna radiating section 204. Waveguide flanges 216 and 218, and waveguide flanges 218 and 220 are formed at the ends of coupling portions respectively of feed waveguides 206 and 208. Waveguide flanges 216, 218, 220 and 222 couple to mating flanges (not shown) in stripline comparator 210.

Figure 9:
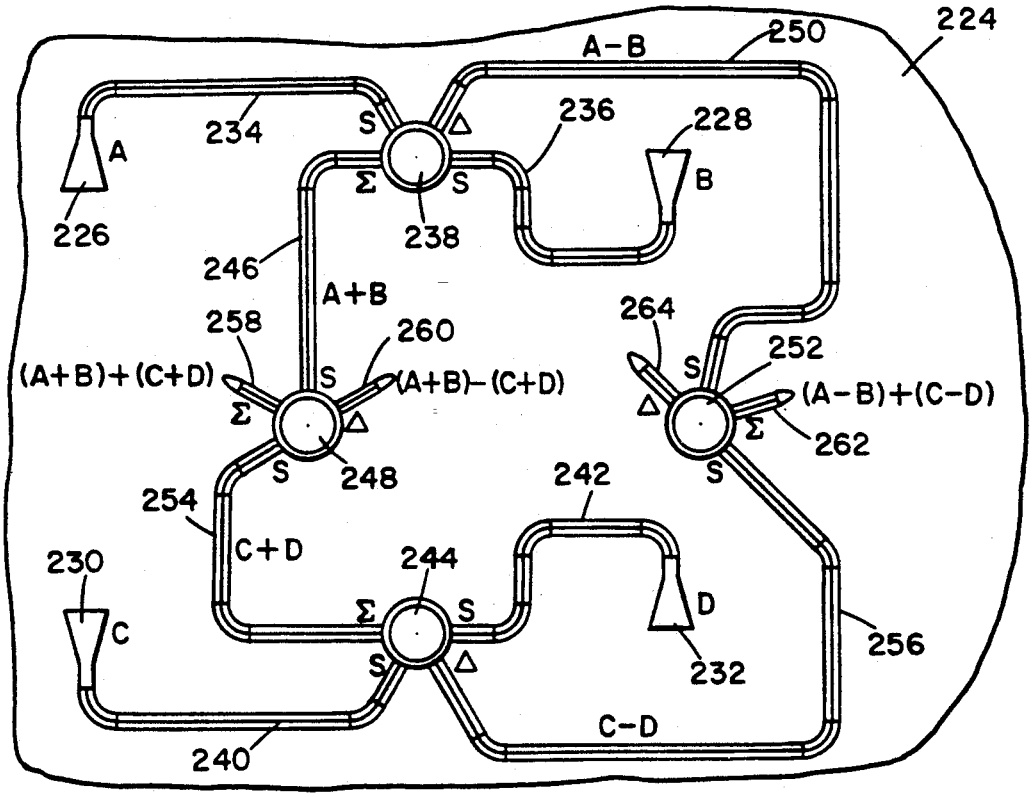
FIG. 9 is a circuit layout for a stripline monopulse comparator for an antenna assembly of FIG. 8.

FIG. 9 illustrates the stripline circuit layout for stripline monopulse comparator 210 of FIG. 8. In FIG. 9, the stripline comparator circuitboard 224 is illustrated as a dielectric substrate having formed a conductive layer on a surface thereof, conductive strips along with stripline elements such as waveguide to stripline transitions, hybrid tees and output ports. The stripline circuit includes four waveguide to stripline transitions 226, 228, 230 and 232 for coupling electromagnetic energy from the feed waveguide, at a respectively aligned waveguide flange, to the stripline circuit. Transitions 226 and 228 respectively couple antenna signals, labeled A and B, via stripline conductive strips 234 and 236, which form the symmetry arms of stripline hybrid tee 238, to hybrid tee 238. Similarly, transitions 230 and 232 are respectively couple antenna signals, labeled C and D, via conductive strips 240 and 242, which also serve as symmetry arms for hybrid tee 244, to hybrid tee 248.

The sum port of hybrid tee 238 is coupled by conductive strip or symmetry arm 246 to hybrid tee 248 so as to provide the signal (A+B) to hybrid tee 248. The difference port of hybrid tee 238 is coupled by conductive strip or symmetry arm 250 of hybrid tee 252 to provide the signal (A−B) to hybrid tee 252. Similarly, the sum port of hybrid tee 244 is coupled by conductive strip or symmetry arm 254 of hybrid tee 248 to provide the signal (C−D) to hybrid tee 248. The difference port of hybrid tee 244 is coupled by conductive strip or symmetry arm 256 of hybrid tee 252 to provide the signal (C−D) to hybrid tee 252.

Hybrid tee 248 has both a sum port and a difference port which is respectively coupled by conductive strips or output ports 258 and 260. Hybrid tee 248 provides the signal (A+B)+(C+D) at output port 258 as the antenna sum signal. Hybrid tee also provides the signal (A+B)−(C+D) at output port 260 as the antenna elevation signal. Similarly, hybrid tee 252 has a sum and difference port respectively coupled by conductive strips or output ports 262 and 264. Hybrid tee 252 provides the signal (A−B)+(C−D) at output port 262 as the antenna azimuth signal. Output port 264 which is coupled to the difference port of hybrid tee 252 is coupled to a terminating load (not shown).

The circuit illustrated in FIG. 9 is configured for a stripline circuit application. It should be further understood to one of ordinary skill in the art that a microstrip circuit may be similarly constructed. Therefore, the term stripline as used in the general sense is intended to include microstrip embodiments which is a type of stripline.

Figure 10:
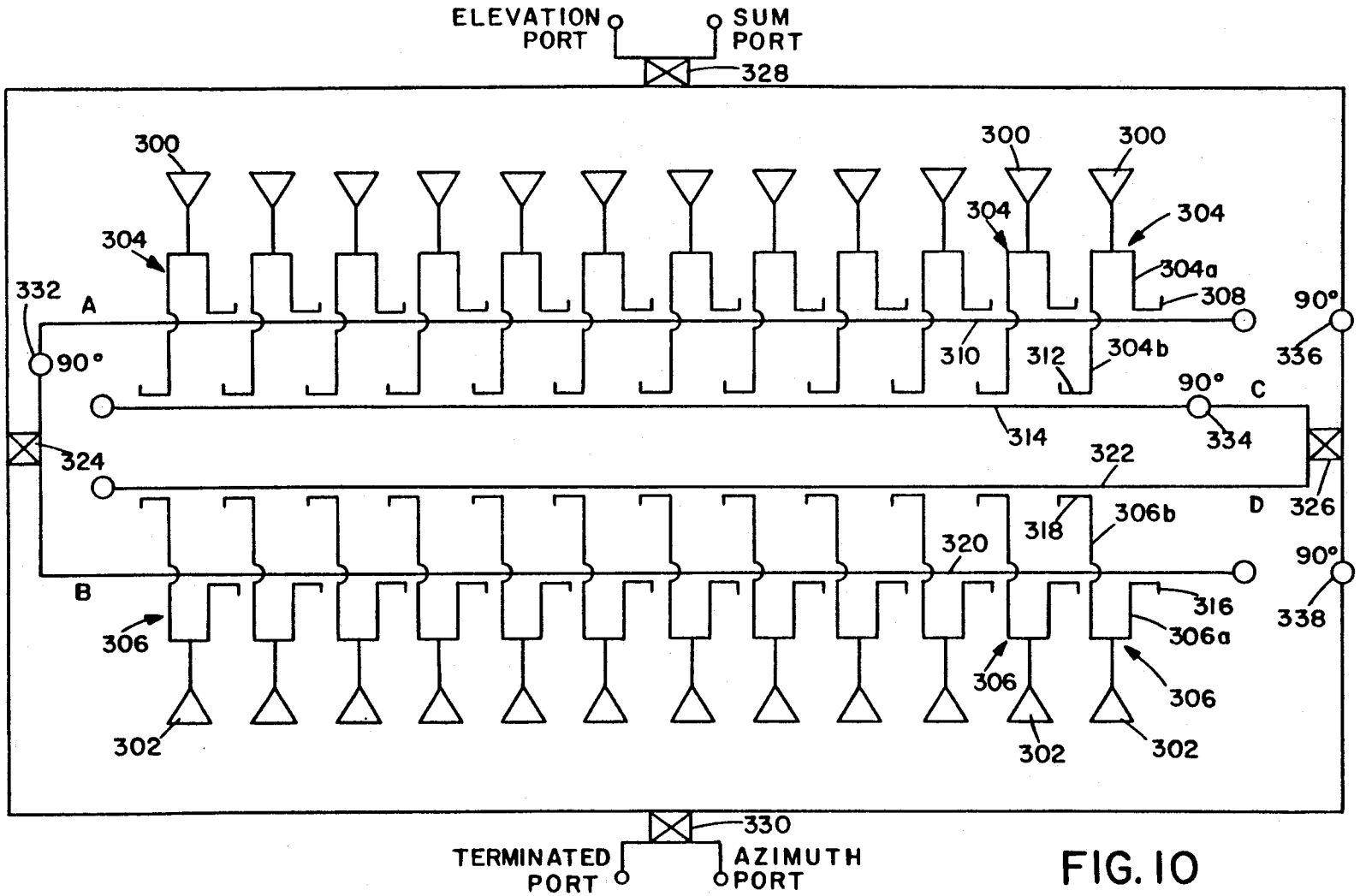
FIG. 10 is a schematic diagram of an integrated stripline feed network and monopulse comparator circuit.

FIG. 10 illustrates in schematical form an integrated stripline feed network and monopulse comparator circuit. In the embodiment of the integrated stripline feed network and monopulse comparator, the antenna feed system utilizes stripline techniques for effecting the beam tilts required for accomplishing the amplitude comparison monopulse radiation characteristics. An antenna radiating section similar to that described with reference to FIG. 1 is utilized with the exception of the backplate. The backplate is typically a solid member having two parallel rows aligned slots with each slot corresponding to a parallel waveguide channel in the antenna radiating section. Each slot in the backplate parallel to the coupling slots which are formed in the antenna radiating section centerplate as described with reference to FIG. 1. The backplate slots are typically located in the region which defined feed openings 30 and 32 of antenna radiating section backplate 16 in FIG. 1.

The signal coupled from each slot in one row of backplate slots is coupled to a respective one of waveguide to stripline transitions 300. Each waveguide to stripline transition 300 is coupled to a stripline power divider 304. One leg of power divider 304, leg 304*a*, is coupled to stripline directional coupler 308. Directional coupler 308 electromagnetically couples a signal to stripline feedline 310. The other leg of power divider 304, leg 304*b*, is connected to stripline directional coupler 312. Directional coupler 312 electromagnetically couples a signal to stripline feedline 314.

Similarly, each coupling slot in the other row of backplate coupling slots are coupled to a respective one of waveguide to stripline transitions 302. Waveguide to stripline transitions 302 are coupled to stripline power dividers 306. Stripline power divider 306 has legs 306*a* and 306*b* respectively connected to stripline directional couplers 316 and 318. Directional couplers 316 and 318 respectively couple a signal on legs 306*a* and 306*b* onto feedlines 320 and 322.

The output from each waveguide to stripline transition from the waveguide radiating sections must be power divided since a stripline coupler is a unidirectional element, as opposed to waveguide couplers which are bidirectional. Therefore, four separate feedlines are required to achieve the four beam positions for this particular stripline configuration, as opposed to only two feedlines needed for the waveguide feed embodiments.

One end of feedlines 312, 314, 320 and 322 are terminated while the other end is coupled to a monopulse comparator. Signals coupled on feedlines 312, 314, 320 and 322 are coupled to the monopulse comparator for signal processing. The monopulse comparator in this particular embodiment is constructed in stripline and consists of four 90 degree hybrid tees, e.g., hybrid tees 324, 326, 328 and 330, in combination with four 90 degree phase delay units, e.g., phase delay units 332, 334, 336 and 338.

A signal coupled to transition 300 is coupled by power divider 304 and directional couplers 308 and 312 respectively, to feedlines 310 and 314. A signal coupled on feedline 310 is coupled through phase delay unit 332 to hybrid tee 324. The signal on feedline 314 is coupled through phase delay unit 334 to hybrid tee 326.

A signal received at transition 302 is coupled through power divider 306 to directional couplers 316 and 318 where the signals are respectively coupled onto feedlines 320 and 322. The signal coupled on feedline 320 is coupled to hybrid tee 324. The signal coupled on feedline 322 is coupled to hybrid tee 326.

One output of hybrid tee 324 is coupled directly to an input of hybrid tee 328. The other output of hybrid tee 326 is coupled to an input of hybrid tee 330. The output of hybrid tee 326 is coupled through phase delay unit 336 to an input of hybrid tee 238. Similarly, the other output of hybrid tee 326 is coupled through phase delay unit 338 to an input of hybrid tee 330.

Hybrid tee 328 has outputs which serve as an antenna sum port and an antenna elevation port. Hybrid tee 330 has outputs which serve as an azimuth port and a terminated port. It should also be understood that rather than using the four 90 degree hybrid tees in conjunction with the four 90 degree phase delay units, a comparator may be constructed using 180 degree hybrid tee power dividers, such a construction being readily which would be understood by one skilled in the art.

With respect to beam positioning, element spacing and dielectric constant of the circuitboard substrate determine the required beam position for achieving satisfactory monopulse performance. It is noted that the feed system affects only the elevation plane. The elevation beam ($\theta$) is determined by the equation:

$$\sin\theta = (\sqrt{\epsilon} - \lambda/2a) \tag{4}$$

where:

$\epsilon$ is a dielectric constant of the board;

$\lambda$ is the antenna center operating frequency; and a is the element spacing.

Figure 11:
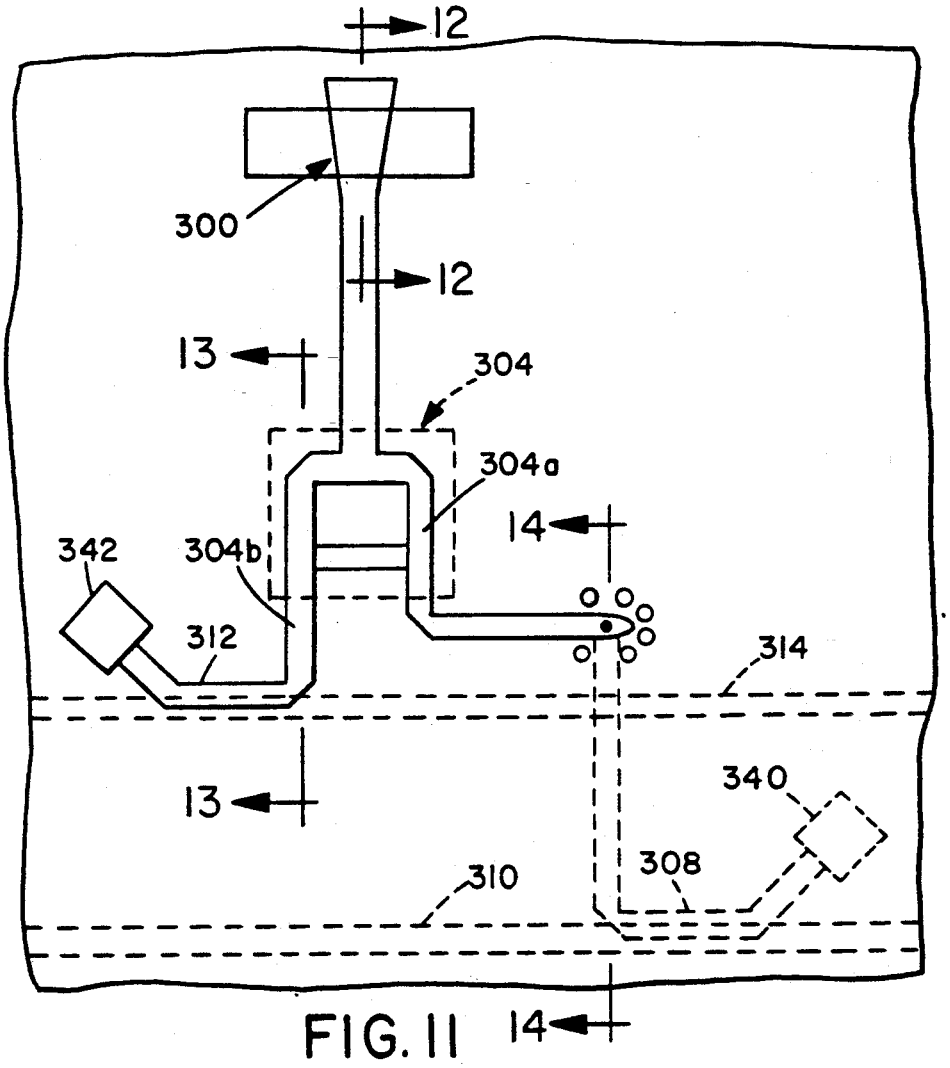
FIG. 11 is a substantially schematic top plan view of a portion of the physical embodiment of the integrated stripline feed network and monopulse comparator circuit of FIG. 10.
Figure 12:
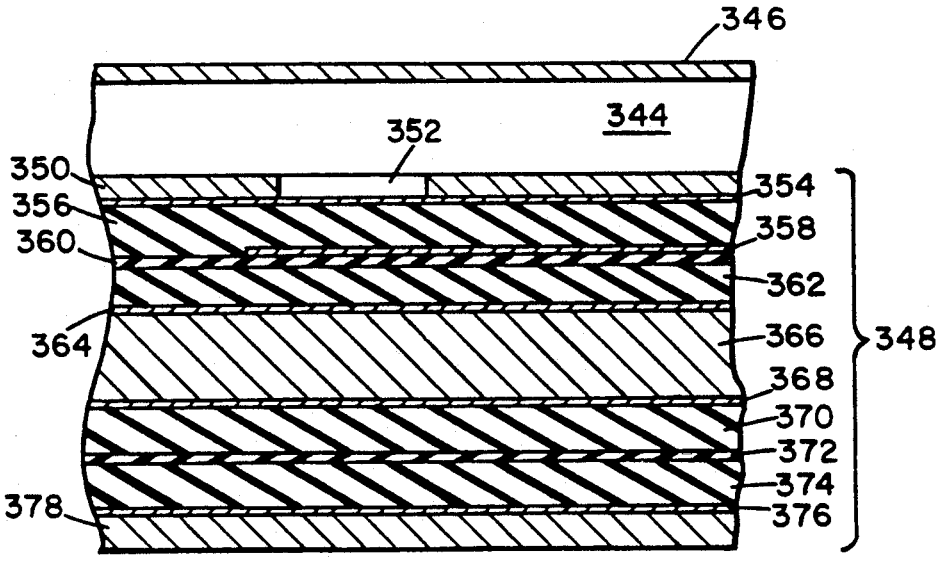
FIG. 12 is a sectional view of the actual physical embodiment of the integrated stripline feed network and monopulse comparator taken along line 12—12 of FIG. 11.
Figure 13:
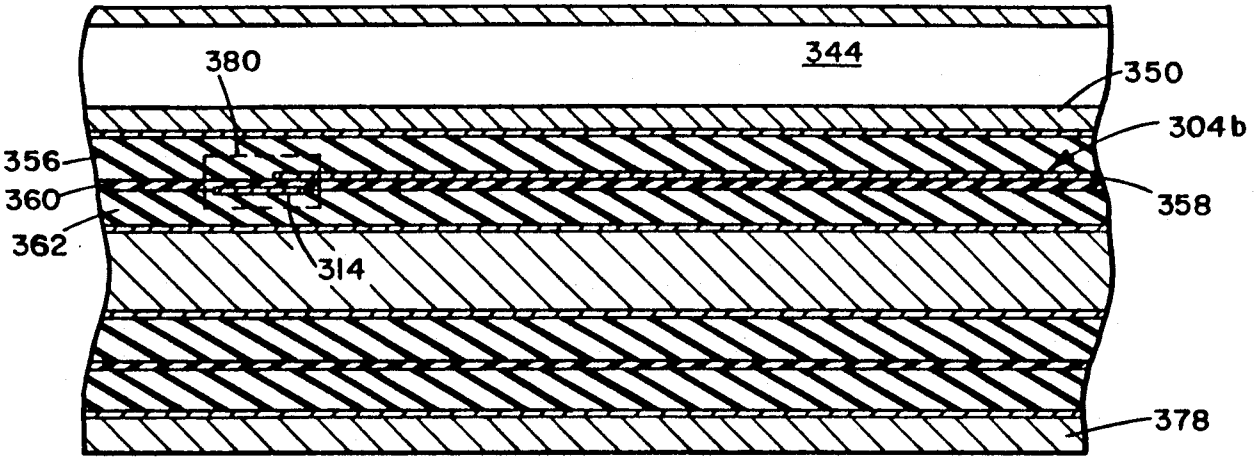
FIG. 13 is a sectional view of the physical embodiment of the integrated stripline feed network and monopulse comparator taken along line 13—13 of FIG. 11.
Figure 14:
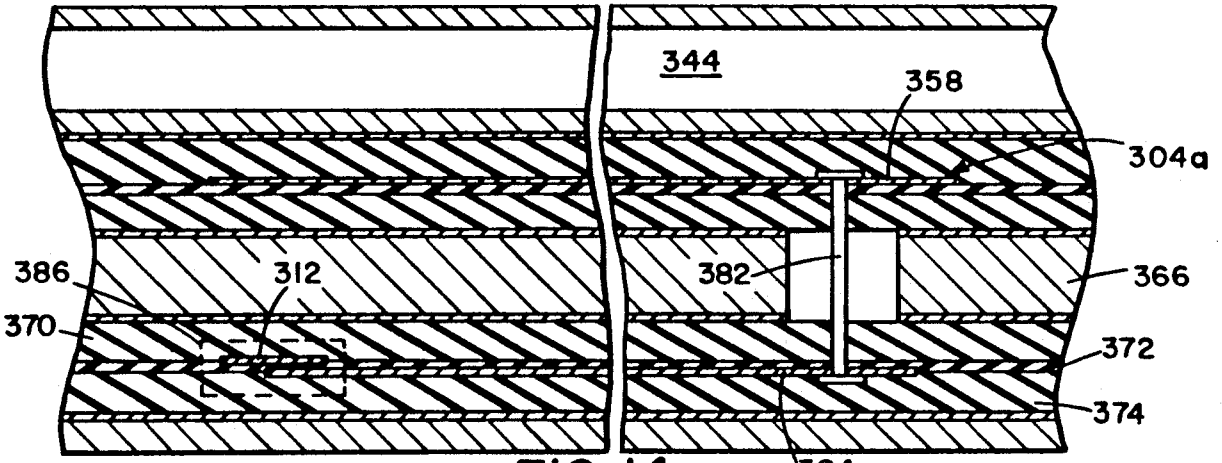
FIG. 14 is a sectional view of the physical embodiment of the integrated stripline feed network and monopulse comparator taken along line 14—14 of FIG. 11.

FIG. 11 is a substantially schematic top plan view of a portion of the physical embodiment of the integrated stripline feed network and monopulse comparator circuit of FIG. 10. FIGS. 12–14 are sectional views taken across various lines in FIG. 11. In FIG. 11, waveguide to the stripline transition 300 is illustrated along with power divider 304 in their conductive strip form. Power divider 304 is coupled by legs 304*a* and 304*b* respectively to directional couplers 308 and 310. Positioned at the end of directional couplers 308 and 310 are respectively stripline terminations 340 and 342.

FIG. 12 illustrates a cross-section taken along line 12—12 of FIG. 11. In FIG. 12, a waveguide channel 344 is formed between backplate 346 and the stripline circuit 348. Typically, backplate 346 in the region of the aligned slots is approximately 0.02 inches thick and constructed of aluminum. The stripline circuit is comprised of an aluminum plate 350, typically 0.03 inches thick, disposed adjacent waveguide channel 344. Formed in plate 350 is an aperture 352 aligned with the stripline conductor of waveguide to stripline transition 300. Stripline circuit 348 is further comprised of a stack of aluminum, copper and dielectric layers to form the overall circuit.

The stripline circuit is configured with aluminum plate 350 with a copper layer 354 positioned adjacent thereof on a surface opposite waveguide channel 344. Positioned adjacent copper layer 354 is a dielectric layer 356. Positioned adjacent dielectric layer 356 is a conductive layer 358 from which is formed the conductive strip for stripline to waveguide transition 300.

Disposed adjacent conductive layer 358 is dielectric layer 360. Positioned adjacent dielectric layer 360 is dielectric layer 362. Dielectric layers 356 and 362 are typically the same thickness and are thicker than dielectric layer 360. Positioned adjacent dielectric layer 362 is conductive layer 364. The stack further includes a spacer 366, typically constructed as an aluminum plate, positioned adjacent conductive layer 364.

Positioned adjacent the other surface of spacer 366 is conductive layer 368. Disposed adjacent conductive layer 368 is dielectric layer 370 which has disposed adjacent it dielectric layer 372. Disposed adjacent dielectric layer 372 is dielectric layer 374. Dielectric layers 370 and 374 are typically identical to dielectric layers 356 and 362, while dielectric layer 372 is typically identical to dielectric layer 360. Conductive layer disposed 376 is then disposed adjacent dielectric layer 374. Positioned adjacent conductive layer 376 is backing plate 378. Backing plate 350 is typically formed from a 0.03 inch thick aluminum plate. Conductive layers 354, 358, 368 and 376 are typically formed from 0.0014 inch thick copper. Typically, dielectric layers 356, 360, 370 and 374 are typically formed from a 0.031 inch thick Duroid dielectric sheet, while dielectric layers 360 and 372 are typically 0.007 inches thick.

FIG. 13 illustrates the region 380 which includes in particular power divider leg **304*b* as formed in conductive layer 358 and feedline 314 formed as a conductive strip disposed between dielectric layers 360 and 362. FIG. 14 illustrates the coupling of the power divider leg 304*a* formed in conductive layer 358 by pin 382 to a continuation thereof in conductive strip 384. Pin 382 is electrically coupled to both conductive layer 358 and conductive strip 384. Pin 382 extends through an aperture in conductive layer 358, 364, 368 and 384; dielectric layers 360, 362, 370 and 372; and spacer 366. Conductive strip is disposed between dielectric layers 372 and 374**.

FIG. 13 further illustrates region 386 which includes the intersection of directional coupler 308 and leg **304*a* at feedline 310. Feedline 310 is formed as a conductive strip disposed between dielectric layers 370 and 372. Feedlines 310 and 314 are typically formed from copper layers of the same thickness as conductive layers 358 and 384. It should be noted that conductive layers 354 and 364 function as the stripline outer conductors while conductive layer 358 and feedline 314 are stripline center conductors. Similarly, conductive layers 368 and 376 also function as stripline outer conductors while conductive layer 384 and feedline 310** are stripline center conductors.

The various embodiments of the present invention illustrate the wide range of feed networks and monopulse comparators that may be readily implemented in the present invention. It is well understood by those skilled in the art that many modifications using waveguide, stripline or microstrip that various alternate embodiments may be readily developed by those skilled in the art based on the teachings of the present invention.

The previous description of the preferred embodiments are provided to enable any person skilled in the art to make or use the present invention. Various modification to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

What is claimed is:

1. A low-profile full aperture traveling wave monopulse antenna assembly comprising:

a circular faceplate having a plurality of parallel rows of radiating apertures formed therethrough;

a circular backplate having a pair of feed openings each extending across said backplate on opposite sides of and parallel to a centrally located chord perpendicular in orientation to said rows of radiating apertures;

a circular centerplate mounted between and spaced apart from said faceplate and said backplate by a plurality of walls forming a plurality of parallel waveguide channels therein, a first set of parallel waveguide channels disposed between said faceplate and said centerplate with each waveguide channel of said first set being parallel to and electromagnetically coupled to a corresponding row of radiating apertures, a second set of parallel waveguide channels disposed between said backplate and said centerplate with each waveguide channel of said second set being symmetrically oriented on an opposite side of said centerplate with respect to a corresponding waveguide of said first set, said centerplate having divider means mounted within said second set of waveguide channels for separating each waveguide channel of said second set into pairs of independent waveguide channels, one waveguide channel of each of said pair of independent waveguide channels coupled to one feed opening with the other waveguide channel of each pair of independent waveguide channels coupled to the other feed opening, said centerplate having a plurality of coupling apertures each formed therethrough adjacent the periphery thereof within the region defined by corresponding waveguide channels of said first and second sets;

a pair of feed waveguides each mounted adjacent said backplate above a different feed opening with one feed waveguide electromagnetically coupled to said one waveguide channel of said pairs of independent waveguide channels and the other feed waveguide coupled to said other waveguide channel of said pairs of independent waveguide channels; and a monopulse comparator mounted adjacent said backplate and operatively coupled to said pair of feed waveguides.

2. The antenna assembly of claim 1 wherein each row of radiating apertures is comprised of a plurality of parallel slots formed alternately on each side of a respective chord spanning said faceplate.

3. The antenna assembly of claim 2 wherein the distance between each radiating aperture slot and a respective chord increases along the length of said chord from the periphery of the faceplate to the midpoint of said chord.

4. The antenna of claim 1 wherein each feed waveguide comprises:

a rectangular radiating portion having a row of radiating slots formed in a surface facing said waveguide channels with said radiating portion defining a first level above said backplate;

a pair of rectangular connector portions each coextensively positioned above said radiating portion in regions adjacent the ends of said radiating portion with said connector portions defining a second level above said backplate;

a pair of coupling slots each respectively positioned in the region adjacent the ends of said radiating portion between said radiating portion and said connector portions, said connector portions and radiating portion being electromagnetically coupled by said pair of coupling slots; and a pair of coupling portions each coupled to a different connector portion at an end opposite said coupling slots and extending perpendicular to said connector portion in said second level, each of said coupling portions having, at an end opposite said connector portion, adapter means for coupling to said monopulse comparator.

5. The antenna system of claim 1 further comprising decoupling means mounted on a surface of said faceplate away from said centerplate for decoupling electromagnetic energy between radiating apertures in adjacent parallel rows of radiating apertures.

6. The antenna system of claim 1 wherein said monopulse comparator comprises a waveguide monnopulse comparator.

7. The antenna system of claim 6 wherein said waveguide monopulse comparator comprises:

first, second, third and fourth hybrid tees each having a pair of symmetry arms, a sum arm and a difference arm, said first hybrid tee symmetry arms each respectively coupled to a different end of one of said feed waveguides with said second hybrid tee symmetry arms each respectively coupled to a different end of the other of said feed waveguides, said third hybrid tee symmetry arms respectively coupled to said first and second hybrid tees difference arms, said fourth hybrid tee symmetry arms respectively coupled to said first and second hybrid tees sum arms.

8. The antenna system of claim 4 wherein said monopulse comparator is a waveguide monopulse comprising:

first, second, third and fourth hybrid tees each having a pair of symmetry arms, a sum arm and a difference arm, said first hybrid tee symmetry arms each respectively coupled to a different end of one of said feed waveguides with said second hybrid tee symmetry arms each respectively coupled to a different end of the other of said feed waveguides, said third hybrid tee symmetry arms respectively coupled to said first and second hybrid tees difference arms, said fourth hybrid tee symmetry arms respectively coupled to said first and second hybrid tees sum arms.

9. A low-profile full aperture traveling wave monopulse antenna assembly comprising:

a circular faceplate having a plurality of parallel rows of radiating apertures formed therethrough;

a circular backplate having a pair of feed openings each extending across said backplate on opposite sides of and parallel to a centrally located chord perpendicular in orientation to said rows of radiating apertures;

a circular centerplate mounted between and spaced apart from said faceplate and said backplate by a plurality of walls forming a plurality of parallel waveguide channels therein, a first set of parallel waveguide channels disposed between said faceplate and said centerplate with each waveguide channel of said first set being parallel to and electromagnetically coupled to a corresponding row of radiating apertures, a second set of parallel waveguide channels disposed between said backplate and said centerplate with each waveguide channel of said second set being symmetrically oriented on an opposite side of said centerplate with respect to a corresponding waveguide of said first set, said centerplate having divider means mounted within said second set of waveguide channels for separating each waveguide channel of said second set into pairs of independent waveguide channels, one waveguide channel of each of said pair of independent waveguide channels coupled to one feed opening with the other waveguide channel of each pair of independent waveguide channels coupled to the other feed opening, said centerplate having a plurality of coupling apertures each formed therethrough adjacent the periphery thereof within the region defined by corresponding waveguide channels of said first and second sets; and an integrated stripline feed network and monopulse comparator mounted adjacent said backplate and operatively coupled to each of said pairs of independent waveguide channels at a corresponding feed opening.

10. A compact, low-profile full aperture traveling wave monopulse antenna assembly comprising:

a circular faceplate having a plurality of parallel rows of radiating apertures formed therethrough;

a circular backplate having a pair of feed openings each extending across said backplate on opposite sides of and parallel to a centrally located chord perpendicular in orientation to said rows of radiating apertures;

a circular centerplate mounted between and spaced apart from said faceplate and said backplate by a plurality of walls forming a plurality of parallel waveguide channels therein, a first set of parallel waveguide channels disposed between said faceplate and said centerplate with each waveguide channel of said first set being parallel to and electromagnetically coupled to a corresponding row of radiating apertures, a second set of parallel waveguide channels disposed between said backplate and said centerplate with each waveguide channel of said second set being symmetrically oriented on an opposite side of said centerplate with respect to a corresponding waveguide of said first set, said centerplate having divider means mounted within said second set of waveguide channels for separating each waveguide channel of said second set into pairs of independent waveguide channels, one waveguide channel of each of said pair of independent waveguide channels coupled to one feed opening with the other waveguide channel of each pair of independent waveguide channels coupled to the other feed opening, said centerplate having a plurality of coupling apertures each formed therethrough adjacent the periphery thereof within the region defined by corresponding waveguide channels of said first and second sets;

a pair of feed waveguides each mounted adjacent said backplate above a different feed opening with one feed waveguide electromagnetically coupled to said ones of said pairs of independent waveguide channels and the other feed waveguide coupled to said others of said pairs of independent waveguide channels each feed waveguide comprising:

a. a rectangular radiating portion having a row of radiating slots formed in a surface facing said waveguide channels with said radiating portion defining a first level above said backplate;

b. a pair of rectangular connector portions each coextensively positioned above said radiating portion in regions adjacent the ends of said radiating portion with said connector portions defining a second level above said backplate;

c. a pair of coupling slots each respectively positioned in the region adjacent the ends of said radiating portion between said radiating portion and said connector portions, said connector portions and radiating portion being electromagnetically coupled by said pair of coupling slots; and d. a pair of coupling portions each coupled to a different connector portion at an end opposite said coupling slots and extending perpendicular to said connector portion in said second level, each of said coupling portions including, at an end opposite said connector portion, adapter means for coupling to a respective symmetry arm; and a monopulse comparator mounted adjacent said backplate operatively coupled to said pair of feed waveguides, said monopulse comparator comprising first, second, third and fourth hybrid tees each having a pair of symmetry arms, a sum arm and a difference arm, said first hybrid tee symmetry arms each respectively coupled to a different end of one of said feed waveguides with said second hybrid tee symmetry arms each respectively coupled to a different end of the other of said feed waveguides, said third hybrid tee symmetry arms respectively coupled to said first and second hybrid tees difference arms, said fourth hybrid tee symmetry arms respectively coupled to said first and second hybrid tees sum arms.

11. The antenna assembly of claim 7 wherein each row of radiating apertures is comprised of a plurality of parallel slots formed alternately on each side of a respective chord spanning said faceplate.

12. The antenna assembly of claim 8 wherein the distance between each radiating aperture slot and a respective chord increases along the length of said chord from the periphery of the faceplate to the midpoint of said chord.

13. The antenna system of claim 7 further comprising decoupling means mounted on a surface of said faceplate away from said centerplate for decoupling electromagnetic energy between radiating apertures in adjacent parallel rows of radiating apertures.

14. The antenna system of claim 10 wherein said decoupling means comprises a plurality of clavin pins with each pin each mounted on an opposite side of a radiating aperture.

* * * * *